US005219823A

United States Patent [19]

Chapman

[11] Patent Number: 5,219,823

[45] Date of Patent: Jun. 15, 1993

[54] STABILIZERS FOR CYANINE IR DYES IN DONOR ELEMENT FOR LASER-INDUCED THERMAL DYE TRANSFER

[75] Inventor: Derek D. Chapman, Rochester, N.Y.

[73] Assignee: Eastman Kodak Company, Rochester, N.Y.

[21] Appl. No.: 872,872

[22] Filed: Apr. 23, 1992

[51] Int. Cl.[5] ..... B41M 5/035; B41M 5/38

[52] U.S. Cl. ..... 503/227; 428/195; 428/913; 428/914; 430/200; 430/201; 430/945

[58] Field of Search ..... 8/471; 428/195, 913, 428/914; 430/200, 201, 945; 503/227

[56] References Cited

U.S. PATENT DOCUMENTS

| | | | |
|---|---|---|---|
| 3,298,898 | 1/1967 | Gall | 161/199 |
| 4,973,572 | 11/1990 | DeBoer | 503/227 |

FOREIGN PATENT DOCUMENTS

| | | | |
|---|---|---|---|
| 805074 | 9/1972 | Belgium | 503/227 |
| 1424620 | 2/1976 | United Kingdom | 430/270 |

*Primary Examiner*—B. Hamilton Hess
*Attorney, Agent, or Firm*—Harold E. Cole

[57] ABSTRACT

This invention relates to a dye donor element for laser-induced thermal dye transfer comprising a support having thereon a dye layer comprising an image dye in a polymeric binder and a cyanine infrared absorbing dye associated therewith, and wherein said layer also has a nitrosonaphthol ferrous complex associated therewith.

18 Claims, No Drawings

STABILIZERS FOR CYANINE IR DYES IN DONOR ELEMENT FOR LASER-INDUCED THERMAL DYE TRANSFER

This invention relates to the use of stabilizers for cyanine infrared dyes in the donor element of a laser-induced thermal dye transfer system.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In U.S. Pat. No. 4,973,572, there is described a dye-donor element for laser-induced thermal dye transfer comprising a dye layer containing a cyanine infrared absorbing material. There is a problem with these infrared materials in that their stability to light is not as good as one would desire.

It is an object of this invention to provide a stabilizer for cyanine infrared dyes which are used in a laser dye transfer system.

In GB 1,424,620, U.S. Pat. No. 3,298,898 and BE 805,074, there are disclosures of nitrosonaphtholferrous complexes used in molding compositions for accelerating photodegradation, as an interlayer in safety glass and as IR absorbers, respectively. There is no disclosure in these references, however, that such complexes are useful as stabilizers for cyanine infrared dyes.

These and other objects are achieved in accordance with this invention which relates to a dye donor element for laser-induced thermal dye transfer comprising a support having thereon a dye layer comprising an image dye in a polymeric binder and an cyanine infrared absorbing dye associated therewith, and wherein said layer also has a nitrosonaphthol ferrous complex associated therewith.

Any nitrosonaphthol ferrous complex may be employed in the invention. In a preferred embodiment, the nitrosonaphthol-ferrous complex has the following formula:

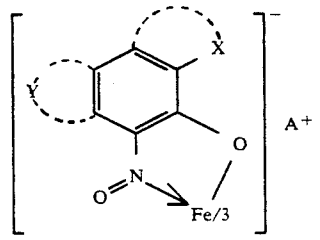

wherein:

X and Y each independently represents hydrogen or the atoms necessary to complete a fused, substituted or unsubstituted aromatic ring, with the proviso that both X or Y cannot be hydrogen at the same time, and with the further proviso that when Y is an aromatic ring, then X can be hydrogen, acetamido, alkyl or alkoxy of 1–4 carbon atoms, nitro, sulfo or halogen; and A represents a cation, such as ammonium, tetraalkyl ammonium, an alkali metal, 1-alkyl pyridinium, etc.

In another preferred embodiment of the invention, A represents tetraalkyl ammonium, Y represents the atoms necessary to provide a fused naphthol ring, and X represents methoxy or acetamido. In another preferred embodiment, A represents tetraalkyl ammonium, and either X or Y represents the atoms necessary to provide a fused naphthol ring.

Following are examples of the stabilizer complexes which may be employed in the invention:

Stabilizer S-1

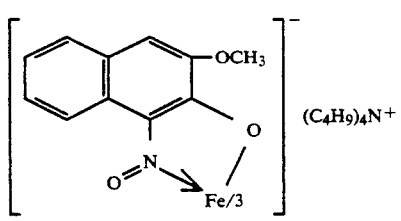

Stabilizer S-2

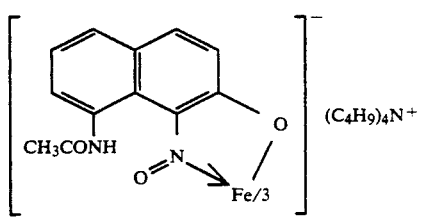

-continued

Stabilizer S-3

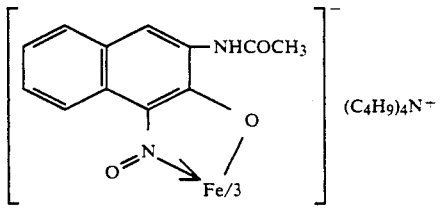

Stabilizer S-4

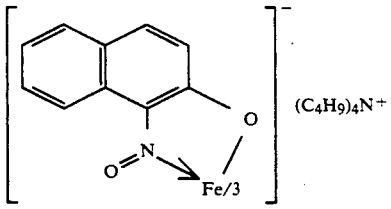

Stabilizer S-5

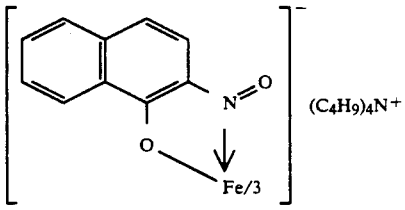

In a preferred embodiment of the invention, the cyanine infrared absorbing dye and the nitrosonaphthol ferrous complex are in the dye layer.

Typical examples of cyanine infrared absorbing dyes which may be used in the invention are disclosed in the above-referenced U.S. Pat. No. 4,973,572, the disclosure of which is hereby incorporated by reference. Specific examples of such cyanine absorbing dyes are as follows:

Cyanine Dye A1

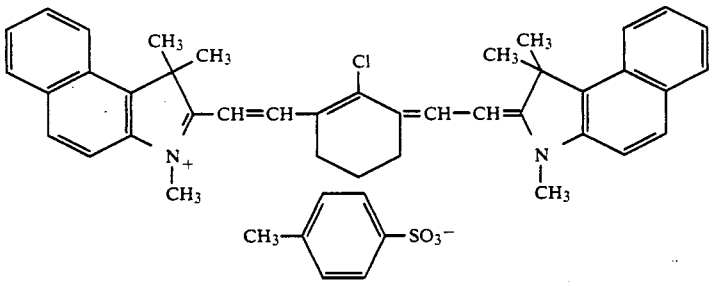

Cyanine Dye A2

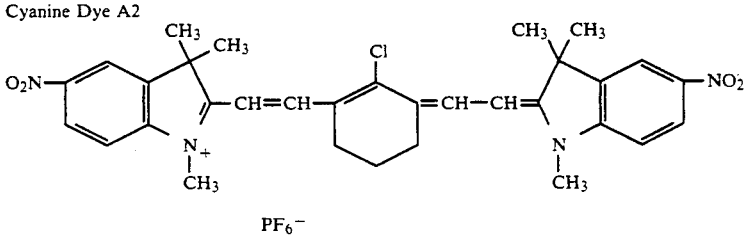

Cyanine Dye A3

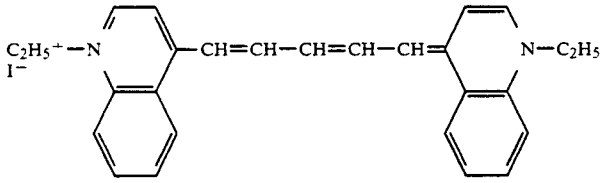

In another preferred embodiment of the invention, instead of the cations listed above for the cyanine dye, the nitrosonaphthol ferrous complex itself can be the counter ion for the cyanine dye.

To obtain the laser-induced thermal dye transfer image employed in the invention, a diode laser is preferably employed since it offers substantial advantages in terms of its small size, low cost, stability, reliability, ruggedness, and ease of modulation. Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses a laser as described above to form an image on a thermal print medium is described and claimed in copending U.S. application Ser. No. 451,656 of Baek and DeBoer, filed Dec. 18, 1989, the disclosure of which is hereby incorporated by reference.

Any image dye can be used in the dye-donor employed in the invention provided it is transferable to the dye-receiving layer by the action of the laser. Especially good results have been obtained with sublimable dyes such as anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant blue BM ®, Kayalon Polyol Dark Blue 2BM ®, and KST Black DR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

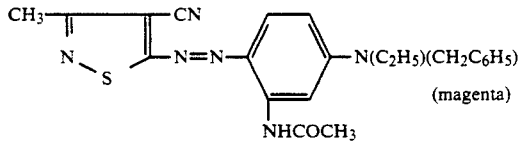

(magenta)

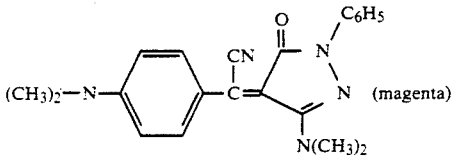

(magenta)

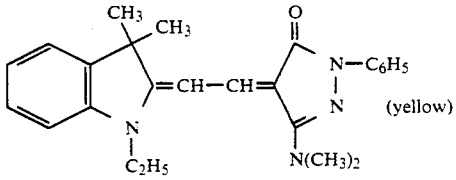

(yellow)

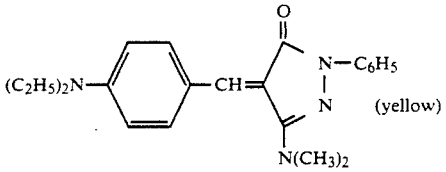

(yellow)

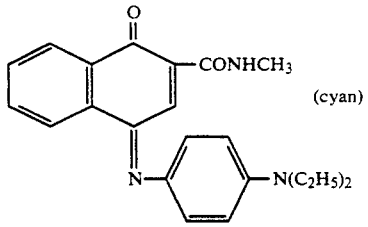

(cyan)

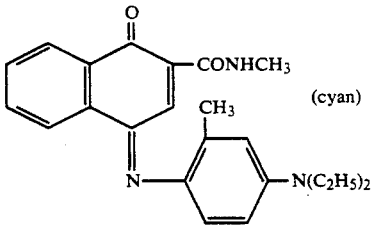

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed single or in combination. The dyes may be used at a coverage of from about 0.05 to about 1 g/m$^2$ and are preferably hydrophobic.

The dye in the dye-donor employed in the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element employed in the invention provided it is dimensionally stable and can withstand the heat of the laser. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 5 to about 200 um. It may also be coated with a subbing layer, if desired, such as those materials described in U. S. Pat. Nos. 4,695,288 or 4,737,486.

The dye-receiving element that is used with the dye-donor element employed in the invention comprises a support having thereon a dye image-receiving layer. The support may be glass or a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek ®. In a preferred embodiment, a transparent film support is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

A process of forming a laser-induced thermal dye transfer image according to the invention comprises:

a) contacting at least one dye-donor element comprising a support having thereon a dye layer comprising an image dye in a polymeric binder having an infrared absorbing material associated therewith, with a dye-receiving element comprising a support having thereon a polymeric dye image-receiving layer;

b) imagewise-heating the dye-donor element by means of a laser; and c) transferring a dye image to the dye-receiving element to form the laser-induced thermal dye transfer image, and wherein the dye-donor element contains a nitrosonaphthol ferrous complex as described above.

The following examples are provided to illustrate the invention.

Synthesis Example 1—Nitrosonaphthol Ferrous Complex

The ferrous complexes of nitrosonaphthols are not commercially available but some of the nitrosonaphthols themselves are. The synthesis of all the complexes is made in exactly the same way as follows:

The desired nitrosonaphthol (0.01 mol) is dissolved in tetrabutylammonium hydroxide (25 ml of 0.4M solution) and treated with a solution of ferrous chloride (0.7 g) in water (5 ml). The product is precipitated, filtered off, and washed with water. After drying in the oven, the product is purified by chromatography on silica gel.

Synthesis Example 2—IR Dye-Nitrosonaphthol Ferrous Complex

The nitrosonaphthol ferrous complex may replace the anion of a given infrared absorbing dye to create a single complex of infrared dye and nitrosonaphthol ferrous complex stabilizer as the anion. This may be prepared as follows:

Infrared cyanine dye A1 (0.75 g) is dissolved in methanol (5. ml) and the nitrosonaphthol ferrous complex S4 (0.85 g), prepared as described above, is dissolved in methanol and added with stirring. The mixture is heated to boiling and the precipitated solid is filtered off and dried.

EXAMPLE 1

Individual yellow dye-donor elements were prepared by coating on a 100 μm poly(ethylene terephthalate) support;

1) a subbing layer of poly(acrylonitrile-co-vinylidene chloride-co-acrylic acid) (0.054 g/m$^2$) (14:79:7 wt. ratio); and
2) a dye layer containing the yellow dye illustrated below (0.27 g/m$^2$), one of the cyanine infrared absorbing dyes illustrated above (0.054 g/m$^2$) as identified in Table 1, and one of the stabilizers illustrated above (0.054 g/m$^2$ or 0.11 g/m$^2$) as identified in Table 1, in a cellulose acetate propionate binder (2.5% acetyl, 45% propionyl) (0.27 g/m$^2$) coated from dichloromethane.

Control dye-donors without the stabilizer were also coated.

Yellow Dye

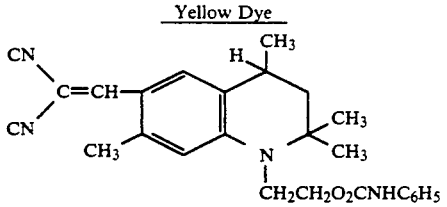

The spectral absorption curve of each coating was obtained by means of a spectrophotometer. Each coating was then exposed for two days at 22° C. to a 1 kLux fluorescence source. At the end of this time, the absorption curves of the samples were again read and the loss in transmission density at the wavelength maximum of the infrared dye was measured. The following results were obtained:

TABLE 1

| DONOR WITH YELLOW DYE | | DENSITY AT IR MAX | | |
|---|---|---|---|---|
| IR DYE | FERROUS STABILIZER | INITIAL | AFTER FADE | % LOSS |
| A1 | None (Control) | 0.89 | 0.32 | 64 |
| A1 | S1 (0.054 g/m$^2$) | 0.90 | 0.66 | 27 |
| A1 | S2 (0.054 g/m$^2$) | 0.86 | 0.63 | 27 |
| A1 | S3 (0.054 g/m$^2$) | 0.93 | 0.65 | 30 |
| A1 | S4 (0.054 g/m$^2$) | 0.89 | 0.70 | 21 |
| A1 | S5 (0.054 g/m$^2$) | 0.91 | 0.68 | 25 |
| A1* | S4* | 0.77 | 0.69 | 10 |
| A2 | None (control) | 1.02 | 0.60 | 42 |
| A2 | S4 (0.054 g/m$^2$) | 1.2 | 1.0 | 17 |
| A3 | None (control) | 0.65 | 0.14 | 79 |
| A3 | S4 (0.11 g/m$^2$) | 0.66 | 0.43 | 35 |

*This coating contained the infrared absorbing dye A1 with ferrous stabilizer S4 as the anion (0.097 g/m$^2$)

The data above show that the light fade of a given cyanine infrared absorbing dye is minimized when coated with a ferrous nitrosonaphthol complex as a stabilizer in a laser thermal dye transfer donor.

EXAMPLE 2

This example is similar to Example 1 but contains a magenta imaging dye in the dye-donor rather than a yellow dye.

Dye donors were prepared as in Example 1 except the following magenta dye was used:

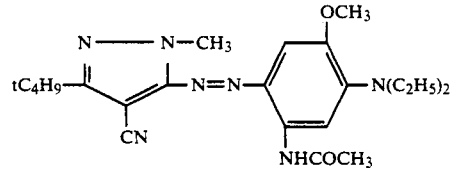

The evaluation procedure was the same as described in Example 1. The following results were obtained:

TABLE 2

| DONOR WITH YELLOW DYE | | DENSITY AT IR MAX | | |
|---|---|---|---|---|
| IR DYE | FERROUS STABILIZER | INITIAL | AFTER FADE | % LOSS |
| A1 | None (control) | 0.75 | 0.39 | 48 |
| A1 | S4 (0.11 g/m$^2$) | 0.87 | 0.77 | 11 |
| A1* | S4* | 0.89 | 0.84 | 6 |

*This coating contained the infrared absorbing dye A1 with ferrous stabilizer S4 as the anion (0.097 g/m$^2$).

The data above show that the light fade of a given cyanine infrared absorbing dye is minimized when coated with a ferrous nitrosonaphthol complex as a stabilizer in a dye-donor containing a magenta imaging dye.

The invention has been described in detail with particular reference to preferred embodiments thereof, but it will be understood that variations and modifications can be effected within the spirit and scope of the invention.

What is claimed is:

1. In a dye donor element for laser-induced thermal dye transfer comprising a support having thereon a dye layer comprising an image dye in a polymeric binder and an cyanine infrared absorbing dye associated therewith, the improvement wherein said layer also has a nitrosonaphthol ferrous complex associated therewith.

2. The element of claim 1 wherein said cyanine infrared absorbing dye and said nitrosonaphthol ferrous complex are in said dye layer.

3. The element of claim 1 wherein said nitrosonaphthol ferrous complex has the following formula:

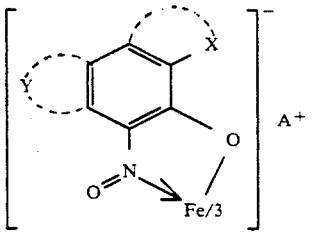

wherein:

X and Y each independently represents hydrogen or the atoms necessary to complete a fused, substituted or unsubstituted aromatic ring, with the proviso that both X or Y cannot be hydrogen at the same time, and with the further proviso that when Y is an aromatic ring, then X can be hydrogen, acetamido, alkyl or alkoxy of 1-4 carbon atoms, nitro, sulfo or halogen; and A represents a cation.

4. The element of claim 3 wherein A represents tetraalkyl ammonium, Y represents the atoms necessary to provide a fused naphthol ring, and X represents methoxy or acetamido.

5. The element of claim 3 wherein A represents tetraalkyl ammonium, and either X or Y represents the atoms necessary to provide a fused naphthol ring.

6. The element of claim 1 wherein said nitrosonaphthol ferrous complex is the counter ion for said cyanine dye.

7. In a process of forming a laser-induced thermal dye transfer image comprising:

a) contacting at least one dye-donor element comprising a support having thereon a dye layer comprising an image dye in a polymeric binder having a cyanine infrared absorbing dye associated therewith, with a dye-receiving element comprising a support having thereon a polymeric dye image-receiving layer;

b) imagewise-heating said dye donor element by means of a laser; and c) transferring a dye image to said dye-receiving element to form said laser-induced thermal dye transfer image, the improvement wherein said dye layer also has a nitrosonaphthol ferrous complex associated therewith.

8. The process of claim 7 wherein said cyanine infrared absorbing dye and said nitrosonaphthol ferrous complex are in said dye layer.

9. The process of claim 7 wherein said nitrosonaphthol ferrous complex has the following formula:

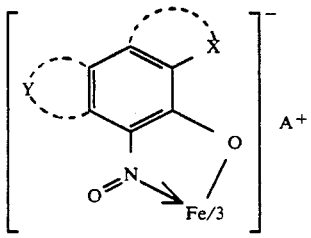

wherein:

X and Y each independently represents hydrogen or the atoms necessary to complete a fused, substituted or unsubstituted aromatic ring, with the proviso that both X or Y cannot be hydrogen at the same time, and with the further proviso that when Y is an aromatic ring, then X can be hydrogen, acetamido, alkyl or alkoxy of 1–4 carbon atoms, nitro, sulfo or halogen; and A represents a cation.

10. The process of claim 9 wherein A represents tetraalkyl ammonium, Y represents the atoms necessary to provide a fused naphthol ring, and X represents methoxy or acetamido.

11. The process of claim 9 wherein A represents tetraalkyl ammonium, and either X or Y represents the atoms necessary to provide a fused naphthol ring.

12. The process of claim 7 wherein said nitrosonaphthol ferrous complex is the counter ion for said cyanine dye.

13. In a thermal dye transfer assemblage comprising:

(a) a dye donor element comprising a support having thereon a dye layer comprising an image dye dispersed in a polymeric binder having a cyanine infrared absorbing dye associated therewith, and (b) a dye-receiving element comprising a support having thereon a dye image-receiving layer, said dye-receiving element being in superposed relationship with said dye-donor element so that said dye layer is in contact with said dye image-receiving layer, the improvement wherein said dye layer also has a nitrosonaphthol ferrous complex associated therewith.

14. The assemblage of claim 13 wherein said cyanine infrared absorbing dye and said nitrosonaphthol ferrous complex are in said dye layer.

15. The assemblage of claim 13 wherein said nitrosonaphthol ferrous complex has the following formula:

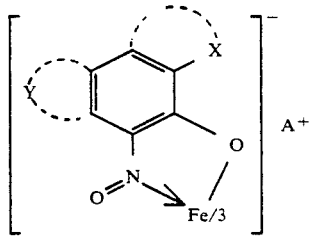

wherein:

X and Y each independently represents hydrogen or the atoms necessary to complete a fused, substituted or unsubstituted aromatic ring, with the proviso that both X or Y cannot be hydrogen at the same time, and with the further proviso that when Y is an aromatic ring, then X can be hydrogen, acetamido, alkyl or alkoxy of 1–4 carbon atoms, nitro, sulfo or halogen; and A represents a cation.

16. The assemblage of claim 15 wherein A represents tetraalkyl ammonium, Y represents the atoms necessary to provide a fused naphthol ring, and X represents methoxy or acetamido.

17. The assemblage of claim 15 wherein A represents tetraalkyl ammonium, and either X or Y represents the atoms necessary to provide a fused naphthol ring.

18. The assemblage of claim 13 wherein said nitrosonaphthol ferrous complex is the counter ion for said cyanine dye.

* * * * *